United States Patent [19]

Nam

[11] Patent Number: 4,638,635

[45] Date of Patent: Jan. 27, 1987

[54] INTERNAL COMBUSTION ENGINE SYSTEM

[76] Inventor: Chul W. Nam, No. 225-13, Sinwoul-Dong, Kangseo-ku, Seoul, Rep. of Korea

[21] Appl. No.: 735,243

[22] Filed: May 17, 1985

Related U.S. Application Data

[63] Continuation-in-part of Ser. No. 438,647, Nov. 3, 1982, Pat. No. 4,531,480.

[51] Int. Cl.[4] ..... F02B 73/00

[52] U.S. Cl. ..... 60/716; 60/616; 60/698; 123/19

[58] Field of Search ..... 60/400, 616, 620, 698, 60/716, 517, 525; 123/19, 52 B

[56] References Cited

U.S. PATENT DOCUMENTS

| | | | |
|---|---|---|---|
| 3,180,078 | 4/1965 | Liston | 60/616 X |
| 3,998,049 | 12/1976 | McKinley et al. | 123/19 X |
| 4,205,638 | 6/1980 | Vlacancinch | 123/19 X |

*Primary Examiner*—Stephen F. Husar
*Attorney, Agent, or Firm*—Armstrong, Nikaido, Marmelstein & Kubovcik

[57] ABSTRACT

An internal combustion engine system has an engine body provided with a main combustion engine which generates power by gas explosion and a power transmission apparatus for transmitting to the crank shaft a greater power than is produced by the gas explosion. A booster is provided for providing oil pressure to the power transmission apparatus, an accumulator for maintaining constant control of the pressure in the power transmission apparatus, and a swash plate-type stirling engine connected to the exhaust gas outlet of the main combustion engine. A turbo charger is provided for forcing a supply of fresh air to the combustion chamber by using the exhaust gas. A one-stage screw-type compressor is coupled to the swash plate-type stirling engine so as to generate compressed air, and a plurality of compressed air sources are provided for storing compressed air.

7 Claims, 11 Drawing Figures

INTERNAL COMBUSTION ENGINE SYSTEM

This application is a continuation-in-part of application Ser. No. 438,647 filed Nov. 3, 1982, now U.S Pat. No. 4,531,480.

BACKGROUND AND SUMMARY OF THE INVENTION

This application is to provide an internal combustion engine system for enhancing the net thermal efficiency of the conventional internal combustion engine, in particular to provide an internal combustion engine system for a four-stroke diesel engine. In the above U.S. patent application No. 438,647 disclosed by Mr. C. W. Nam, now U.S. Pat. No. 4,531,480, the piston power transmission apparatus is constructed in accordance with Pascal's Law which states that a confined fluid transmits externally applied pressure uniformly in all directions without change in magnitude. Substantially, the piston power transmission apparatus in the cited reference comprises an upper cylinder block and a lower cylinder block provided wtih a top piston and a bottom piston individually. The space between the top piston and bottom piston is filed with compressed oil. Also an upper cylinder block is divided into an internal chamber and an external chamber by a vertical wall, whereby the pressure of the upper cylinder, which is equal to that of the general cylinder produced by the gas explosion during the power stroke, is transmitted through the fluid oil to the bottom piston so that said pressure is multiplied by the cross-sectional area ratio between the top piston and the bottom piston. But such a piston power transmission apparatus has disadvantages and problems. For example, as the upper piston is reciprocated at a high velocity along the vertical wall in the upper cylinder block, the temperature of the fluid oil therein is greatly increased due to the oil pumping action and engine combustion heat notwithstanding the cooling action by the cooling water jacket mounted in the upper cylinder block. Also, even though the vertical wall and the upper piston are accurately casted and the piston ring, oil ring and seal ring are fitted into the ring groove of the upper piston to prevent the oil from leaking into the combustion chamber, a small quantity of fluid oil is introduced into the combustion chamber, thereby resulting in incomplete combustion and air pollution.

Therefore, this invention is constructed to solve the above problems and to overcome the above disadvantages. In other words, this invention is designed to prevent fluid oil leakage, and to reduce a rise in oil temperature during piston reciprocation. Also, this invention is provided with a wasteheat circulating system which utilizes exhaust gas heat from the main combustion engine as described in detail hereafter.

It is the object of this invention to transmit to the pumping piston of the power transmission apparatus the torque of the first crank shaft generated in the main combustion engine, which is separated from a power transmission apparatus to avoid abrupt rises in temperature.

It is another object of this invention to communicate the swash plate-type stirling engine with the exhaust gas outlet of the main combustion engine and to connect the one-stage screw-type compressor to the drive shaft of the swash plate-type stirling engine so that compressed air for operating the booster is produced, wherein the booster applies to the piston power transmission apparatus a relatively greater oil pressure.

It is another object of this invention to mount the crank shaft in an upper portion of the booster in order to smoothly operate the booster which exerts great oil pressure to the power transmission apparatus. It is another object of this invention to form a small orifice on a rod guide of the power piston to circulate the fluid oil, thereby giving a buffering action to the pumping piston rod during the operation of the engine system, wherein a pumping piston rod is connected to the pumping piston of the piston power transmission apparatus. It is another object of this invention to couple by means of the first crank shaft, the upper connecting rod of the combustion chamber piston mounted in the main combustion engine with a Y-type lower connecting rod of the pumping piston which drives the power transmission apparatus.

It is another object of this invention to operate the booster by the compressed air which is generated in the one stage screw-type compressor connected through the drive shaft of the swash plate-type stirling engine, using the exhaust gas heat, thereby forcing the booster to generate a greater force than is produced by the compressor alone, and to enhance net thermal efficiency by applying a relatively great oil pressure from the booster to the power piston of the power transmission apparatus which has a larger cross-sectional area than that of the combustion chamber piston or the pumping piston. As to this, an engine system in accordance with this invention is constructed as follows:

The engine body is provided with a main combustion engine for generating power and a power transmission apparatus for transmitting to the crank shaft a relatively larger power increased by the ratio of the cross-sectional areas between the combustion piston and power piston. The combustion engine and the power transmission apparatus are coupled together at their flanges by bolts.

The combustion chamber piston of the main combustion engine and the pumping piston of the power transmission apparatus are both coupled together with a first crank shaft of the main combustion engine by two connecting rods to have the same stroke distance. A swash plate-type stirling engine is mounted adjacent the exhaust gas outlet of the main combustion engine to operate by means of the exhaust gas heat from the combustion engine and to make the one-stage screw-type compressor, connected directly by a drive shaft to said stirling engine, generate compressed air.

A turbo charger is mounted adjacent the gas outlet to force a supply of fresh air into the combustion chamber of the main combustion engine. A booster is mounted between the compressed air source and the power transmission apparatus to amplify the air pressure derived from the compressed air source, and then to provide the amplified air pressure to the power transmission apparatus by operation of the cam in accordance with the rotation of the first crank shaft. An accumulator is assembled to communicate with the power transmission apparatus through the fluid oil pipe, thereby maintaining constant control of the oil pressure in the power transmission apparatus. Also, the booster for applying oil pressure to the external chamber of the power transmission apparatus in accordance with this invention is comprised of three portions; and upper portion receiving a crank shaft for smoothly operating the booster, a compressed air cylinder, in which a larger cross-sectional piston is mounted, and an oil cylinder, in which a smaller cross-sectional piston is mounted. Further, the main combustion engine in accordance with this invention is constructed so that the stroke distance of the combustion chamber piston is equal to that of the pumping piston of the power transmission apparatus. Namely, the upper connecting rod of the combustion chamber piston couples the two upper portions of the Y-shaped lower connecting rod of the pumping piston together with the first crank shaft mounted in the crank block of the combustion engine.

BRIEF DESCRIPTION OF DRAWINGS

These and other objects as well as advantages of this invention will become clear by the following description of a preferred embodiment of this invention with reference to the accompanying drawings, wherein.

DESCRIPTION OF INVENTION

Figure 1:
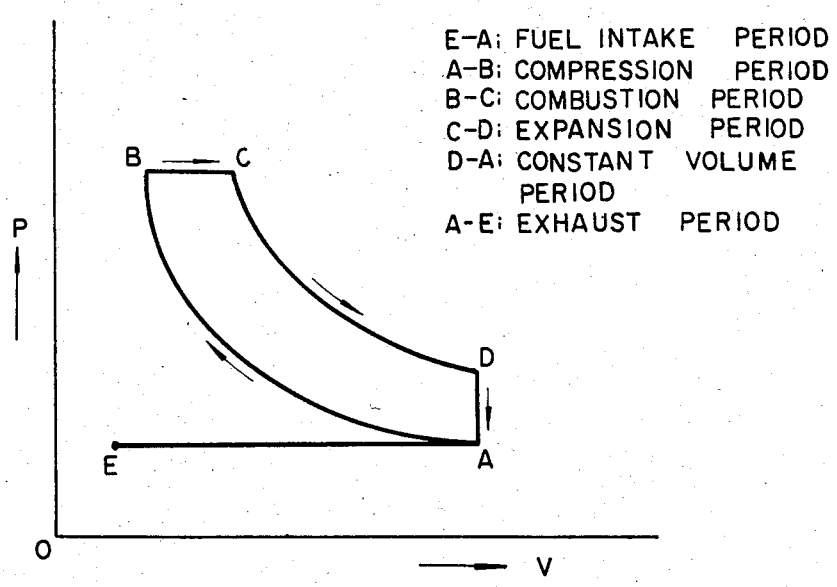
FIG. 1 is a chart showing the P-V relationship of four-stroke diesel engines.

As an example, the combustion process of a conventional diesel engine is illustrated in FIG. 1 which is a chart showing the P-V relationship of a four-stroke engine.

In FIG. 1, the following process periods are illustrated:

E-A: Pressure equilibrium, Air intake period.

A-B: Heat insulation, Compression period.

B-C: Constant pressure, Heat supply period or Combustion period.

C-D: Heat insulation, Expansion period.

D-A: Constant volume period.

A-E: Pressure equilibrium, exhaust period.

The above cycle is comprised of 4 steps, namely two insulation periods, one contant pressure period and one constant volume period.

In the four-stroke diesel engine, the intake stroke, compression stroke, explosion stroke, and exhaust stroke all operate as independent strokes. Therefore one cycle is completed by two rotations of the crank shaft. Refering to FIG. 2, the internal combustion engine system in accordance with one embodiment of this invention comprises an engine body 101 provided with main combustion engine 1 which generates power by gas explosion and a power transmission apparatus 2 for transmitting to the crank shaft a greater power than is produced by the gas explosion, and a booster 102 for providing oil pressure to the power transmission apparatus, and an accumulator 103 for maintaining constant control of oil pressure in the power transmission apparatus 2, and a swash plate-type stirling engine 104 connected to the exhaust gas outlet 14 of the main combustion engine, and a turbo charger 105 for forcing a supply of fresh air to combustion chamber 5 of the main combustion engine 1 by using the exhaust gas, and a one-stage screw-type compressor 106 coupled to swash plate-type stirling engine 104 so as to generate compressed air, and a plurality of compressed air sources 107 for storing the compressed air. Namely above booster 102 and accumulator 103 are communicated with the external chamber 32 formed around the peripheral edge of pumping cylinder 25 by fluid oil pipes 109. 109', 110. Said one-state screw-type compressor 106 is coupled to said swash plate-type stirling engine 104 through drive shaft 106' so that the compressed air generated in said one-stage screw-type compressor 106 is applied to said booster 102.

Figure 3:
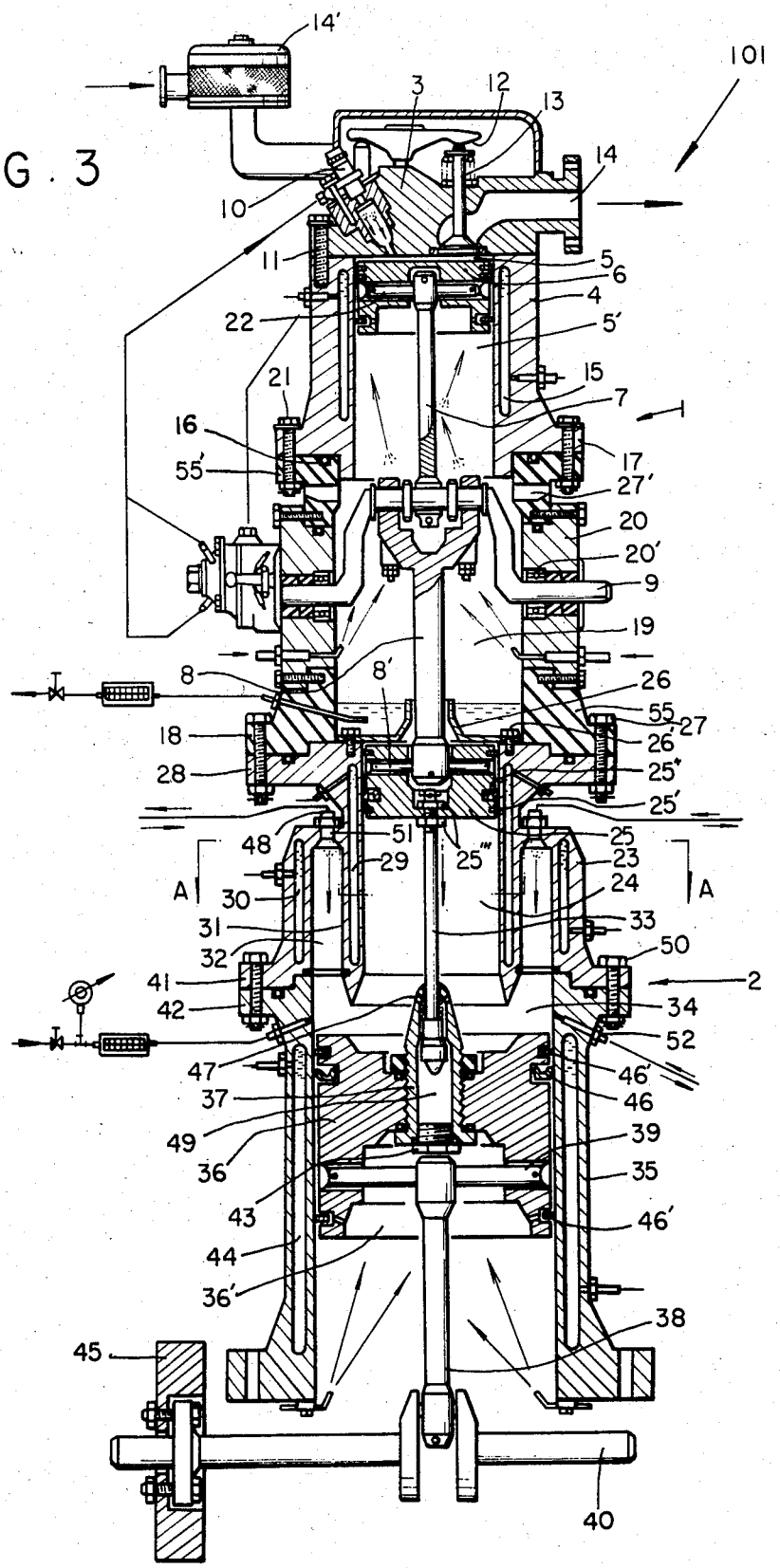
FIG. 3 is a cross-sectional view of the engine body in accordance with this invention.
Figure 4:
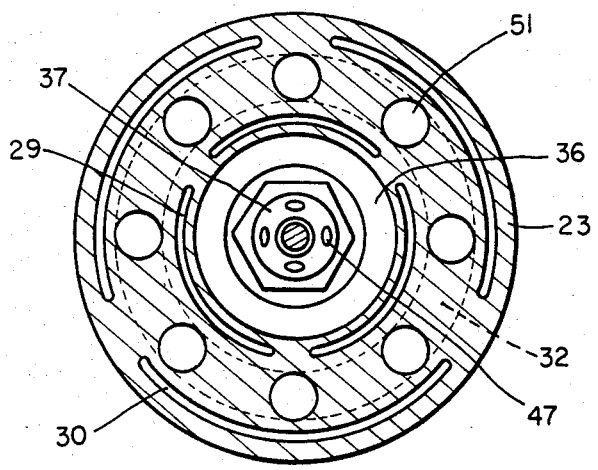
FIG. 4 is a cross-sectional view of line A—A of FIG. 3.

Said plurality of compressed air sources 107 is assembled between said pipes 111 and 112 to store compressed air generated in said compressor 106. Also, said turbo charger 105 is arranged between stirling engine 104 and combustion chamber 5 of main combustion engine 1 to be communicated with each other by exhaust gas pipe 104' and the fresh air pipe 105'. Therefore, the internal combustion engine system of this invention is constructed so that it first drives the swash plate-type stirling engine by using the exhaust gas from the combustion engine, and then makes the one-stage screw-type compressor 106, which is coupled by drive shaft 106' to the above stirling engine, generate compressed air, and then applies the compressed air through compressed air pipes 111, 112 to booster 102, and then forces booster 102 to generate a greater oil pressure than that of the compressor, and then introduces the oil pressure into the power cylinder of the power transmission apparatus through oil pipes 109, 109', and then transmits to power crank shaft 40 an increased force in proportion to the cross-sectional areas of power piston 36 and combustion chamber piston 6. The configuration of the engine body in accordance with one embodiment of this invention is illustrated in FIG. 3 and FIG. 4. Main combustion engine 1 adapted to the four-cycle diesel engine, and power transmission apparatus 2 for transmitting a relatively large power to power crank shaft 40 are coupled at their respective lower flange 18 and upper flange 28 by bolt 27 to main combustion engine 1. Cylinder head 3 is fixed by bolt 11 to the combustion cylinder block 4 with gasket arranged there between. Cylinder head 3 is provided with fuel injection nozzle 10 and intake and exhaust valve device 12 for intake of fresh air and exhaust of combustion gas, and also cylinder head 3 comprises the fresh air intake port(not shown) and exhaust gas port 14 which are respectively communicated with air cleaner 14' and swash plate-type stirling engine 104(as described hereafter).

Combustion cylinder block 4, bolted to the cylinder head by bolt 11, has a combustion chamber 5 formed therein to slidably reciprocate combustion chamber piston, and water jacket 15 formed therein around the peripheral portion of combustion cylinder block 4 to cool the combustion chamber. Such combustion cylinder block 4 is integrally joined with crank block 55 by coupling together lower flange 17 of combustion cylinder block 4 and upper flange 55' of crank block 55 by bolts 21 between which is placed an O-ring. Crank block 55 has an upper flange 55' bolted to a lower flange 17 of combustion cylinder block 4 and a lower flange 18 bolted to pumping cylinder block 23 of power transmission apparatus 2. Therefore, in crank block 55 there is provided a crank chamber 19 in which first crank shaft 9 is rotated by the reciprocation of upper connecting rod 7 of combustion chamber piston 6, thereby reciprocating lower connecting rod 8. Also, crank block 18 has removable bearing supporting block 20 which is formed to support bearing 20' for smoothly rotating first crank shaft 9. Combustion chamber piston 6 is connected by upper connecting rod 7 to first crank shaft 9 to slidably reciprocate in combustion cylinder block 4, wherein one end of upper connecting rod 7 is coupled to combustion chamber piston 6 by piston pin 22. First crank shaft 9, supported by bearing supporting block 20 which is bolted to crank block 55, is coupled to upper connecting rod 7, and the Y-shaped lower connecting rod 8 is connecting to pumping piston 25 of power transmission apparatus 2, thereby making combustion chamber piston 6 and pumping piston 25 to slidably reciprocate in the same stroke as first crank shaft 9 rotates. Oil pan 26 is fixed by bolt 26' to the upper surface of pumping cylinder block 23 within crank block 55. Air vent 27' is formed below upper flange 55' of crank block 55 to prevent pressure from building up in crank chamber 19 and combustion cylinder block chamber 5'.

In the power transmission apparatus, the pumping cylinder block 23 is provided with upper flange 28 and lower flange 41 which are bolted respectively to lower flange 18 of crank block 55 in the main combustion engine and upper flange 42 of power cylinder block 35, and has a pumping cylinder 24 defined by cylindrical vertical wall 31, wherein the cylindrical vertical wall 31 extending from upper flange 28 is provided in pumping cylinder block 23. Cylindrical vertical wall 31 has water jacket 29 for cooling the oil in pumping cylinder 24 while outside the cylindrical vertical wall 31 is an external chamber 32. External chamber 32 is provided with oil pipe fitting 48 and oil orifice 51. Power cylinder block 35, which has power cylinder 34 therein for reciprocating power piston 36, is provided with upper flange 42 coupled by bolt 50 to lower flange 41 of pumping cylinder block 23, and water jacket 44 for preventing oil temperature from rising in power cylinder 34. And below upper flange 42 of power cylinder block 35 is provided oil pipe fitting 52 in which is mounted oil pipe 110 connected to the accumulator so as to maintain the oil pressure in power cylinder 34.

Pumping piston 25 has a stroke distance equal to that of combustion chamber piston and slidably reciprocates by lower connecting rod 8 in crank chamber 19, and has piston ring 25' and oil ring 25" located in their respective grooves together with piston pin 8' to be coupled with lower connecting rod 8. Also, pumping piston 25 is provided with pumping piston rod 33 which is connected to power piston 36 of power transmission apparatus 2.

Power piston 36, slidably reciprocating in power cylinder 34 and having a larger cross-sectional area than that of the pumping piston, has a threaded hole at its center into which rod guide 37 is screwed. Herein one end of pumping piston rod 33 is slidingly reciprocated within rod guid 37. Power piston 36 is provided with sealing ring 46 and piston ring 46' mounted in their respective grooves to prevent oil leakage in power cylinder 34, and has a concave cavity 36' at its base for connecting power connecting rod 38 to the piston by piston pin 39. One end of power connecting rod 38 is connected to power crank shaft 40 and the other end of power crank shaft 40 is fixed to fly wheel 45. Rod guide 37 threaded into the center of power piston 36 has cavity 49 closed by means of bolt 43 and four small orifices 47 to provide a buffering action to pumping piston rod 33 by circulating oil thereinto.

Figure 2:
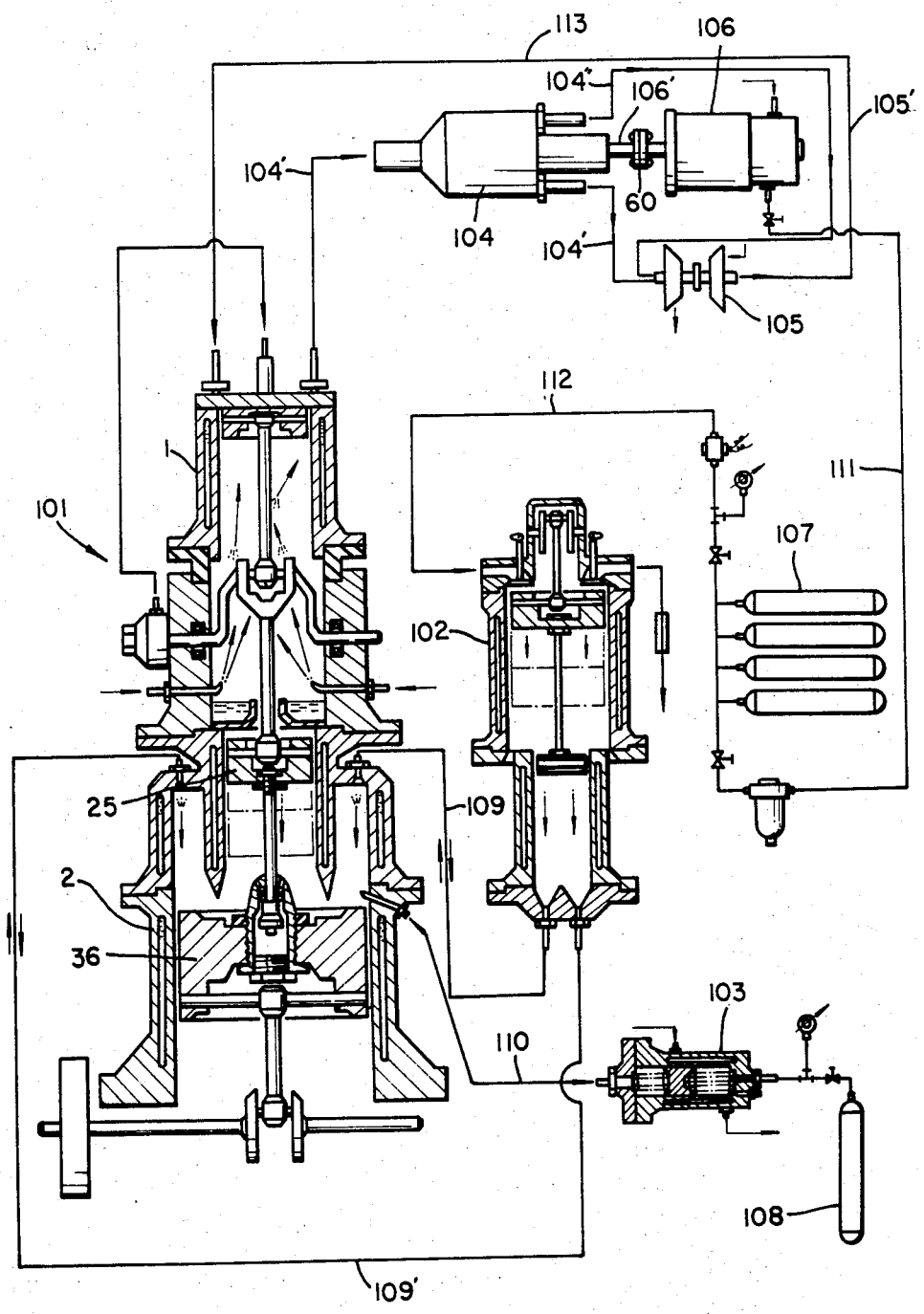
FIG. 2 is a block diagram showing the internal combustion engine system of this invention.
Figure 5:
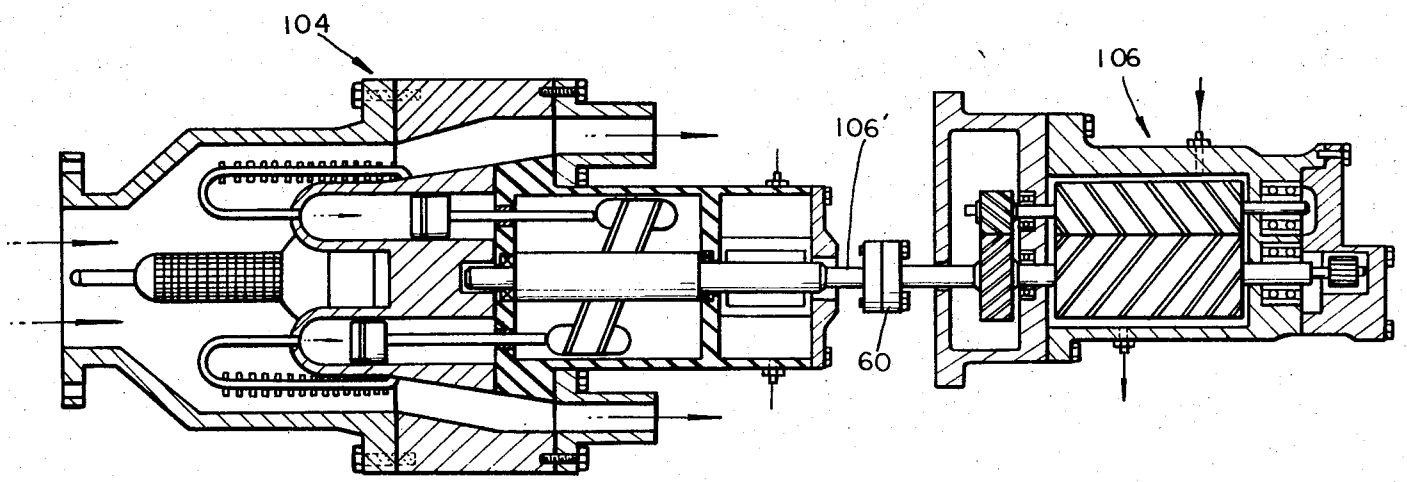
FIG. 5 is a transverse cross-sectional view of the swash plate-type stirling engine and the one stage screw-type compressor in accordance with this invention.

FIG. 5 shows in detail the swash plate-type stirling engine 104 and the one-stage screw-type compressor 106 for utilizing exhaust gas and generating a great amount of compressed air. It is well known that the swash plate-type stirling engine 104 is an engine for expanding the hydrogen gas at the economizer by using exhaust gas heat and converting the high temperature heat into driving power. In this invention, swash plate-type stirling engine 104 is coupled through exhaust gas passage 104' to exhaust gas outlet 14 (FIG. 3). Also, one-stage screw-type compressor 106 is connected through coupling 60 to drivie shaft 106' of swash plate-type stirling engine 104 so that it generates compressed air in accordance with the operation of stirling engine 104. The compressed air is stored within compressed air source 107 through compressed air pipe 111(FIG. 2).

Figure 6:
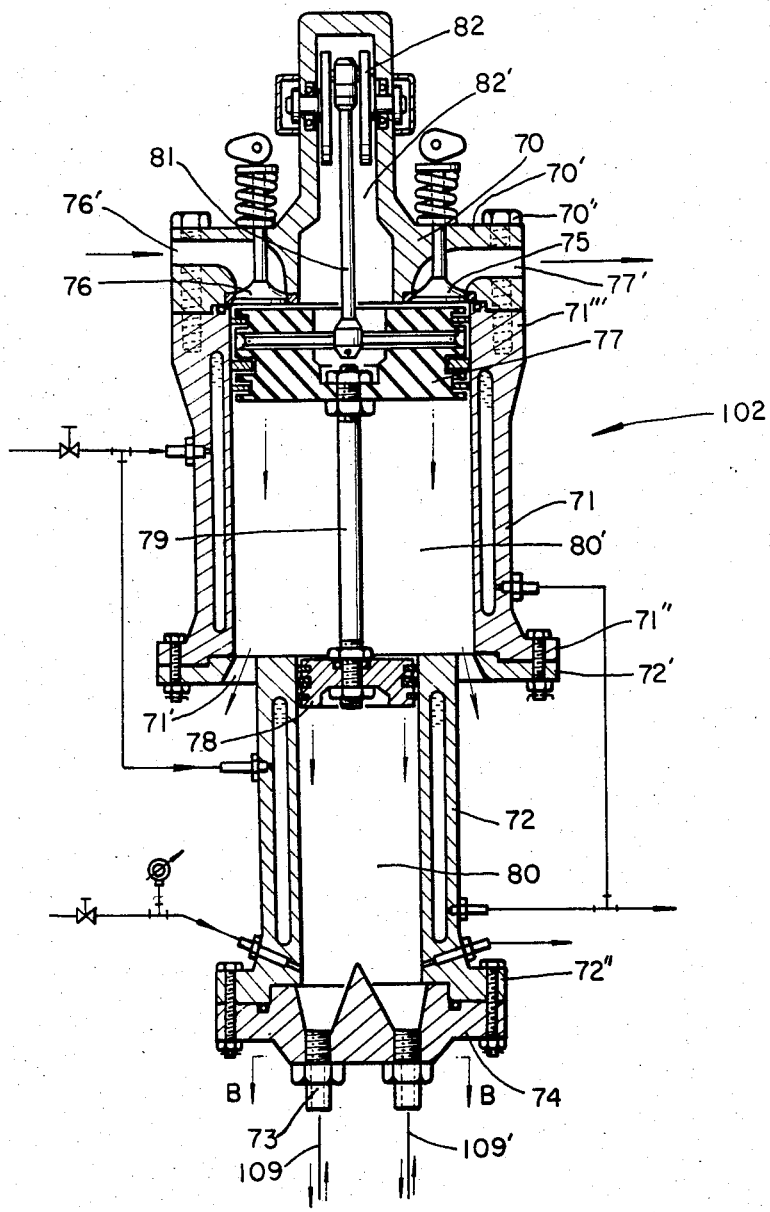
FIG. 6 is a vertical sectional view of the booster in accordance with this invention.
Figure 7:
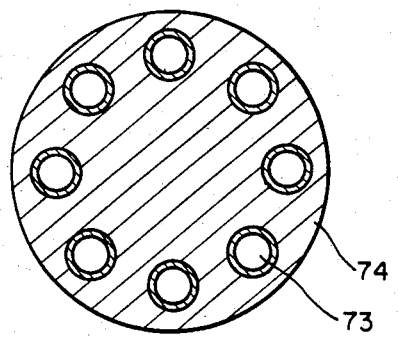
FIG. 7 is a bottom view of the booster.

As shown in FIG. 6 and FIG. 7, booster 102 is operated to compensate for the oil pressure in pumping cylinder 24 so that the stroke distance of power piston 36 is equal to that of combustion chamber piston 6. For example, booster 102 in accordance with this invention is provided with crank cylinder block 70, compressed air cylinder block 71, and oil cylinder block 72. Crank cylinder block 70 comprises crank shaft 82 mounted in crank chamber 82' for smoothly operating booster 102, and connecting rod 81 connected to crank shaft 52, and intake and exhaust valve 76 and 75 for alternative intake and exhaust of compressed air during the operation of the booster, and compressed air inlet 76' and outlet 77' for passage of the compressed air. Compressed air cylinder block 71 is provided with upper piston 77 operated by compressed air from compressor 106 (FIG. 2) in compressed air cylinder 80'. Also, oil cylinder block 72 comprises lower piston 78 in oil cylinder 80 filled with oil, and eight pipe fittings 73 at threaded holes of lower flange 74 to transmit oil pressure to power piston 36. And crank cylinder block 70 and compressed air cylinder block 71 are coupled at their respective lower flanges 70' and upper flanges 71''', by bolts 70" to each other. Similarly lower flange 71" of compressed air cylinder block 71 and upper flange 72' of the oil cylinder block 72 are coupled by bolt and nut to each other, and lower flange 72" of oil cylinder block 72 and lower flange 74 are coupled by bolts. Particularly, the cross-sectional area of compressed air cylinder 80' is larger than that of oil cylinder 80, thus, or the outer edge of said oil cylinder block 72, air vents 71' are provided to allow reciprocation of upper piston 77. Also, one end of crank connecting rod 81 is connected to crank shaft 82 and the other end is coupled by a pin to upper piston 77, and one end of piston connecting rod 79 is connected to upper piston 77 and the other end is connected to lower piston 78.

Therefore, booster 102 generates an oil pressure increased by a ratio of the cross-sectional areas of upper piston 77 and lower piston 78, and transmits the increased oil pressure to power piston 36 of power transmission apparatus 2 in order to compensate for the oil pressure in power cylinder 34 through oil pipes 109, 109', thereby making the stroke distance of combustion chamber piston 6 equal to that of power piston 36 (FIG. 3). On the other hand, crank shaft 82 connected through connecting rod 81 to the upper piston 77 must be mounted in crank chamber 82' to smoothly operate booster 102 at high speeds.

Figure 8:
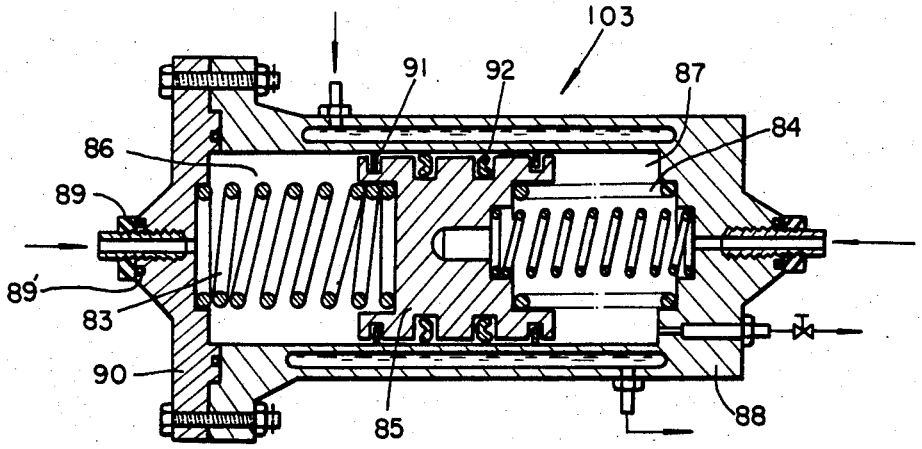
FIG. 8 is a transverse cross-sectional view of the accumulator in accordance with this invention.

As shown in FIG. 8, accumulator 103 is comprised of body 88 which reciprocates balance piston 85 in its cylinders 86, 87, and a pair of coil springs 83, 84 mounted against opposite sides of balance piston 85, and oil pipe fitting 89 bolted to O-ring 89' of flange 90. Therefore, oil cylinder 86 formed at the left of balance piston 85 in the drawing is communicated with power cylinder 36 (FIG. 3), and compressed air cylinder 87 is communicated with the external compressed air tank 108 (FIG. 2). Also, balance piston 85 is provided with piston ring 91 and sealing ring 92 which are inserted in their respective grooves to separate the oil in the oil cylinder from the compressed air in the compressed air cylinder.

Figure 9:
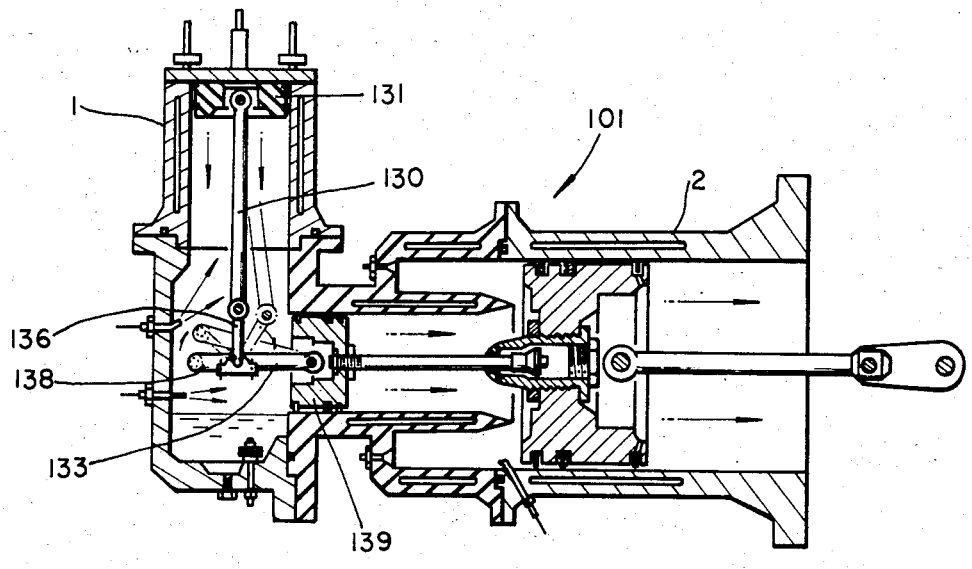
FIG. 9 is a cross-sectional view of other embodiment of a main combustion engine in accordance with this invention.
Figure 10:
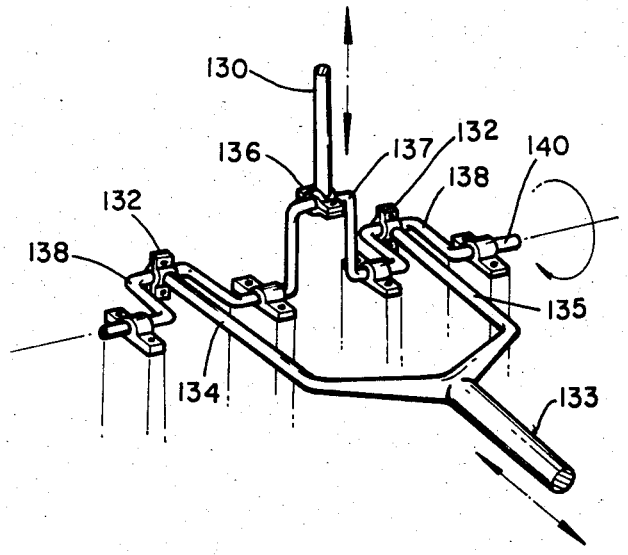
FIG. 10 is an enlarged perspective view of a portion of FIG. 9.

FIG. 9 shows another embodiment of this invention. The main combustion engine 1 and the power transmission apparatus 2 constructed as a part of an engine body 101 are arranged perpendicular to each other. Thus, the configuration of the power transmission apparatus 2 is identical to that of the first embodiment of this invention but the configuration of combustion engine 1 is different from that of the first embodiment. Namely, as shown in FIG. 10, combustion engine 1 has a crank shaft 140 different from that of the first embodiment. Crank shaft 140 has two different shaped parts 137 and 138 which are respectively connected by coupler 136 to connecting rod 130 of combustion chamber piston 131 and connected by couplers 132 to each upper parts 134 and 135 of Y-shaped connecting rod 133, wherein two different shaped parts 137 and 138 have an arrangement in a quadrature relationship between them to transfer the power produced by combustion chamber piston 131 to pumping piston 139. Therefore, an engine can be constructed to have a smaller height than that of the first embodiment.

An explanation of the operation of this invention which is designed as described in detail above is as follows. Referring to FIG. 3, first of all, fly wheel 45 of power crank shaft 40 is rotated by the starting motor(-not shown) to operate engine body 101. As crank shaft 40 rotates, power piston 36 connected by power connecting rod 38 to crank shaft 40 is lowered, thereby pulling one end of pumping piston rod 33 inserted in rod guide 37 at the center of pumping piston 36, and pumping piston 25 together with oil. Thereafter lower connecting rod 8, connected by pin 8' to pumping piston 25, rotates the first crank shaft 9, and upper connecting rod 7 connected to first crank shaft 9 is lowered into the crank chamber 19. Then, because the intake valve(not shown) is opened at 10° to 15° before TDC in combustion chamber 5, fresh air is introduced into combustion chamber 5 through the intake port. And as soon as the power piston 36 in power cylinder 34 of power transmission apparatus 2 reaches the $\frac{2}{3}$ point of the piston stroke, the compressed air intake valve of booster is opened at 45° after TDC and compresses the oil filled therein. The fluid oil compressed in booster 102 is introduced into power cylinder 34 through oil pipes 109, 109' and pushes power piston 36 to reach BDC, thereby completing the intake stroke. Then, after combustion chamber piston 6, pumping piston 25, and power piston 36 reach BDC, as they begin moving with the intake valve being maintained in a closed position, the air is compressed by means of the oil pressure and heated to a high temperature. Therefore, pumping piston 25 is lifted from BDC to TDC, and also power piston 36 is lifted from BDC to TDC and pushes the oil filled within power cylinder 34 upwards whereby $\frac{2}{3}$ of the oil remains in the pumping cylinder and the other $\frac{1}{3}$ is transferred to booster 102 through oil pipes 109, 109'. Exhaust valve 75 of booster 102 is opened at 15° before TDC and the compressed air within the compressed air cylinder of booster 102 is discharged into the atmosphere through exhaust valve 75 and therefore upper piston 77 of booster 102 is pushed upward, afterwhich all pistons of main combustion engine 1 and power transmission apparatus 2 reach TDC, thereby completing the compression stroke. At that time the air within the combustion chamber of main combustion engine 1 is made favorable for ignition by being heated at a high temperature and compressed at a high pressure.

On the other hand, when the air within combustion chamber 5 is compressed and heated with a high temperature at 6° to 8° before TDC, the fuel is injected at injection nozzle 10 under a pressure of 100 to 200 $kg/cm^2$ by the fuel injection pump(not shown), and ingited and exploded in combustion chamber 5. Thereafter, the maximum explosion pressure within combustion chamber 5 reaches 65 to 75 $kg/cm^2$ at 8° to 12° after TDC and thus lowers combustion chamber piston 6. As combustion chamber piston 6 is lowered, upper connecting rod 7 rotates first crank shaft 9 and lowers pumping piston 25 with the same stroke and compression force as that of combustion chamber piston 6, and then as soon as pumping piston 25 moves downward, the oil within pumping cylinder 24 is compressed and forces pressure against the upper surface of power piston 36. At the same time, the end of pumping piston rod 33 slidably moves within rod guide 37. On the other hand, because the pumping cylinder 24 contains oil in a $\frac{2}{3}$ volume relation to the stroke volume of power cylinder 34, the fluid oil compressed in outer booster 102 at 45° after TDC is introduced into power cylinder 34 through oil pipes 109 and 109', and power piston 36 reaches BDC, thereby completing the explosion stroke.

Then the force of power piston 36 is a product of the force multiplied by the ratio of the cross-sectional areas of combustion chamber piston 6 and power piston 36. As power piston 36 rotates power crank shaft 40 and begins returning upwards, power piston 36 forces $\frac{2}{3}$ of the oil within power cylinder 34 to pumping cylinder 24 and the remaining $\frac{1}{3}$ into oil cylinder 80 of booster 102. The force of pumping piston 25 rotates first crank shaft 9 by lower connecting rod 8. Then, as upper connecting rod 7 pushes combustion chamber piston 6 which is connected to first crank shaft 9, the exhaust gas within combustion chamber 5 is discharged into swash plate-type stirling engine 104 through exhaust valve 13 opened at 45° before TDC, thereby completing the exhaust gas stroke.

Figure 11:
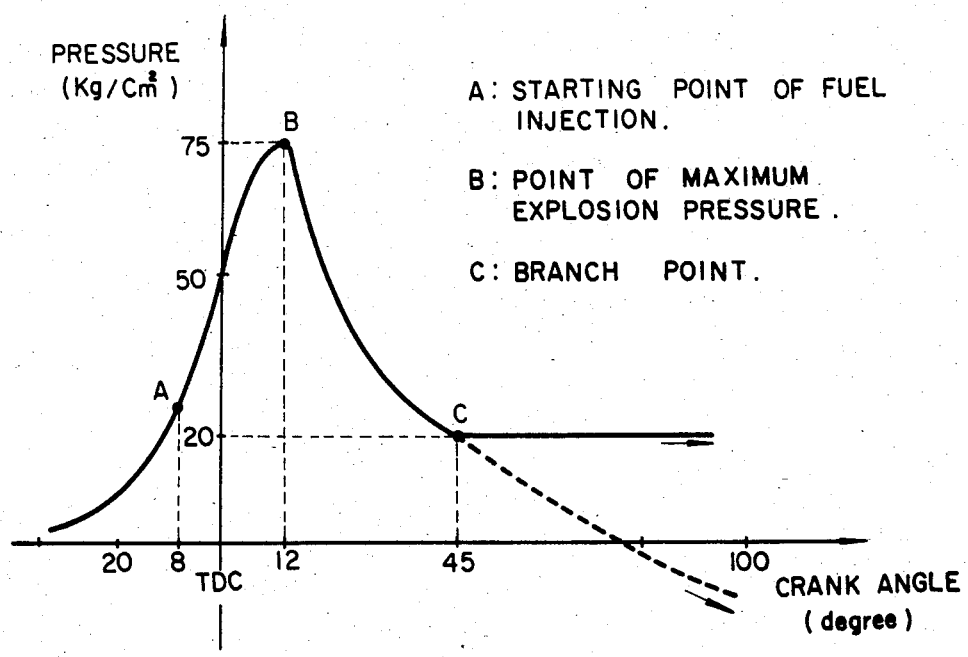
FIG. 11 is a view showing the relationship between the pressure and crank angle in the combustion chamber.

On the other hand, using the high temperature exhaust gas discharged from combustion chamber 5 of the main combustion engine 1, swash plate-type stirling engine 104 is rotated and then one-stage screw-type compressor 106 is driven by rotating shaft 106' of said stirling engine 104, and turbo charger 105 is operated by the exhaust gas discharged through gas pipes 104' and 104" from said stirling engine 104, thereby feeding fresh air to combustion chamber 5, and then as booster 102 is operated by compressed air from said compressor 106 with the continuation of the operation outlined above. Accumulator 103 is operated by compressed air tank 108 to maintain constant oil pressure in pumping cylinder 24 and power cylinder 34. The internal combustion engine for four-cycle diesel engines in accordance with this invention has a characteristic curve as shown in FIG. 11. As is shown in the chart, the explosion pressure in the combustion chamber of conventional four-cycle diesel engines, indicated by a dotted-line, reaches maximum point B at 8° to 10° after TDC and abruptly decreases at 45° ater TDC. Therefrom the force for providing pressure to the piston is made much weaker, thereby reducing the crank shaft torque. Bus as shown by the solid line, this invention is identical to conventional engines in that the explosion pressure in the main combustion chamber reaches a maximum at 8° to 10° after TDC, but different in that when the gas pressure in the combustion chamber becomes 20 kg/cm$^2$, this invention prevents abrupt reduction of crank shaft torque because the upper portion of power piston 36 is compressed by a pressure of 20 kg/cm$^2$ from outer booster 102.

Also, this invention can produce crank shaft torque by a greater power which is a product of the ratio of the cross-sectional areas of the pumping piston and the power piston, thereby enhancing the net thermal efficiency by 63% in comparison to conventional combustion engines. Particularly this invention relates to an internal combustion engine system provided with a waste-heat exhaust gas re-circulating system.

What is claimed is:

1. An internal combustion engine:

an engine body including a main combustion engine for transmitting the power generated by explosion pressure to a pumping piston and a power transmission apparatus for transmitting to a power crank shaft power that is increased by the ratio of the cross-sectional area of a combustion chamber piston to a power piston, wherein the stroke distance of the combustion chamber piston is equal to that of the power piston;

a swash plate-type stirling engine coupled to an exhaust gas outlet of said main combustion engine to be driven by exhaust heat therefrom;

a one-stage screw-type compressor coupled by a driving shaft to the swash plate-type stirling engine, thereby generating a great amount of compressed air;

a turbo-charger mounted adjacent to a gas outlet of the stirling engine to force a supply of fresh air into the combustion chamber of the main combustion engine;

a booster being mounted between a compressed air source and said power transmission apparatus to amplify the air pressure derived from the compressed air source and then provide the amplified air pressure to said power transmission apparatus by operation of a cam in accordance with the rotation of the first crankshaft;

a plurality of compressed air sources being mounted between said compressor and said booster for storing a great amount of compressed air from said compressor; and an accumulator in communication with said power transmission apparatus through a fluid oil pipe, thereby maintaining constant control of the oil pressure in said power transmission apparatus.

2. An internal combustion engine in accordance with claim 1 wherein said crank block has a removable bearing supporting block formed as a part to support the bearing for smoothly rotating a first crank shaft, and said combustion chamber piston is connected by the upper connecting rod to the first crank shaft to slidably reciprocate in the combustion cylinder block, and the crank shaft, supported by said bearing supporting block which is bolted to the crank block is coupled to the upper connecting rod, and the Y shaped lower connecting rod is connecting to the pumping piston of the power transmission apparatus, and oil pan is fixed by a bolt to the upper surface of the pumping cylinder block within the crank block, and an air vent is formed immediately below the upper flange of the crank block to prevent pressure from building up in the crank chamber and the combustion cylinder block chamber.

3. An internal combustion engine system in accordance with claim 1, wherein said power transmission apparatus further comprises a rod guide threaded into the center of the power piston which has a cavity, closed by means of a bolt, and four small orifices to provide a buffering action to a pumping piston rod by circulating oil thereinto.

4. An internal combustion engine in accordance with claim 1 wherein said booster further comprises a crank cylinder block, a compressed air cylinder block, and an oil cylinder block, in which the crank cylinder block has a crank shaft mounted in the crank chamber for smoothly operating said booster, and the compressed air cylinder block has a compressed air piston operated by compressed air from said compressor in the compressed air cylinder, and also the oil cylinder block has an oil piston mounted within the oil cylinder and eight pipe fittings at threaded holes of a lower flange to transmit oil pressure to the power piston of the power transmission apparatus, wherein the cross-sectional area of the compressed air cylinder is larger than that of the oil cylinder, thus, air vents are provided between them on the outer edge of said oil cylinder, to allow reciprocation of the upper piston.

5. an internal combustion engine in accordance with claim 1 wherein said accumulator further comprises a body receiving a balance piston therein and a pair of coil springs mounted against opposite sides of the balance piston, and a oil pipe fitting bolted to the flange.

6. An internal combustion engine, comprising:

an engine body including a main combustion engine for transmitting the power generated by explosion pressure to the pumping piston and a power transmission apparatus for transmitting to a power crank shaft the power that is increased by the ratio of the cross-sectional areas of a combustion chamber piston to a power piston, wherein the main combustion engine and the power transmission apparatus are arranged perpendicular to each other;

a swash plate-type stirling engine coupled to the exhaust gas outlet of the main combustion engine to be driven by the exhaust gas heat;

a one-stage screw type compressor coupled by a drive shaft to the swash plate-type stirling engine, thereby generating a great amount of compressed air;

a turbo-charger mounted adjacent to a gas outlet to force a supply of fresh air into the combustion chamber of the main combustion engine;

a booster mounted between the compressed air source and said power transmission apparatus to amplify the air pressure derived from the compressed air source and then provided the resulting amplified air pressure to said power transmission apparatus by operation of a cam in accordance with the rotation of a first crank shaft;

a plurality of compressed air sources mounted between said compressor and said booster for storing a great amount of compressed air from said compressor; and an accumulator in communication with said power transmission apparatus through a fluid oil pipe, thereby maintaining constant control of the oil pressure in said power tansmission apparatus.

7. An internal combustion engine system in accordance with claim 6 wherein said main combustion engine has a crank shaft that has two different shaped parts which are respectively connected by a coupler to a connecting rod of the combustion chamber piston and connected by a coupler to each of the two upper ends of a Y-shaped connecting rod, wherein the two different shaped parts are arranged in a quadrature relationship to transfer power produced by the combustion chamber piston to the power piston.

* * * * *